United States Patent [19]

Masterson

[11] 3,975,935

[45] Aug. 24, 1976

[54] REMOVABLE CASE FOR LUG LOCKING DEVICE AND ASSEMBLY THEREOF

[76] Inventor: James A. Masterson, 3635 Monogram, Long Beach, Calif. 90808

[22] Filed: Jan. 2, 1975

[21] Appl. No.: 537,970

[52] U.S. Cl. ..... 70/232; 70/455

[51] Int. Cl.[2] ..... E05B 17/18

[58] Field of Search ..... 70/54, 55, 56, 229, 70/230, 231, 232, 258, 259, 260, 455; 292/DIG. 2; 150/52 K

[56] References Cited

UNITED STATES PATENTS

| | | | |
|---|---|---|---|
| 1,912,872 | 6/1933 | Trautmen | 70/260 |
| 2,247,592 | 7/1941 | Swift | 70/455 |
| 2,564,012 | 8/1951 | Jordan | 70/455 |
| 2,585,331 | 2/1952 | King | 70/455 |
| 3,423,971 | 1/1969 | Brunelli | 70/231 |
| 3,540,245 | 11/1970 | Pope | 70/231 |
| 3,625,035 | 12/1971 | Brummer | 70/455 |

*Primary Examiner*—Robert L. Wolfe
*Attorney, Agent, or Firm*—Robert J. Schaap

[57] ABSTRACT

A removable case for covering a lug locking device to protect such locking device from adverse external conditions. The lug locking device includes a central body portion having a continuous side wall and a top wall and a bottom wall. The bottom wall is disposed in juxtaposition to a member which holds the lug. The removable case is provided for disposition over the body of such lug locking device. This removable case includes a top wall which snugly engages the top wall of the locking device and a continuous side wall which snugly engages the continuous side wall of the locking device. In a preferred embodiment of the present invention, the case may include a bottom wall which would extend over a portion of the bottom wall of the locking device. In one aspect of the present invention, the top wall of the cover is removable and in another aspect of the present invention, the top wall is integral with the continuous side wall.

23 Claims, 7 Drawing Figures

REMOVABLE CASE FOR LUG LOCKING DEVICE AND ASSEMBLY THEREOF

BACKGROUND OF THE INVENTION

This invention relates in general to certain new and useful improvements in a removable protective covering case for lug locking devices and, more particularly, to removable protective cases for lug locking devices to protect such devices from adverse external conditions, and assemblies thereof.

In recent years, there have been several provisions for locking devices to prevent unauthorized removal of lugs on wheels of automotive vehicles. Generally, these locking devices have been placed over the lug or similar type of fastening device retaining the spare tire of an automotive vehicle in a secured position. In like manner, these locking devices can also be used to protect the lugs on the operative wheels of the automotive vehicle in order to prevent theft or other forms of unauthorized removal.

In general terms, these conventional lug locking devices comprise an outer housing having a removable case member which is disposed between the frame of a wheel and a housing which extends over the base member. The base member is provided with an enlarged aperture to receive the bolt or similar form of threaded extension and the lug is, in turn, threaded on the bolt and urged into tight fitting engagement with the base of the lug locking device. Thereafter, the housing of this device is connected to the base and securely locked thereto by means of a conventional locking mechanism. In addition, thhse lug locking devices include a key accommodating slot on the top portion thereof to receive a conventional key for actuating the locking mechanism.

Heretofore, there has been no means for protecting the locking device from adverse conditions in the external environment. As a result thereof, these lug locking devices have been subjected to water, mud and other forms of eleterious environment which oftentimes causes the lock to rust-up and sometimes prevents desired removability of the locking device.

The present invention obviates these and other problems in the provision of a protective case which extends over the housing of the locking device to protect such device from adverse external environment.

It is therefore the primary object of the present invention to provide a removable case for a lug locking device to protect this device from adverse external conditions.

It is another object of the present invention to provide a combination of a lug locking device for locking a lug against unauthorized removal thereof and a case for such lug locking device to prevent the device from external adverse conditions.

It is a further object of the present invention to provide a removable case for such lug locking device which extends across all of the exposed surfaces of the lug locking device and, in certain embodiments thereof, to cover relatively unexposed surfaces thereof.

It is an additional object of the present invention to provide a removable cover for a lug locking device which is sized and shaped to engage the body portion of the lug locking device and which is nevertheless, designed for easy removability therefrom.

It is another salient object of the present invention to provide a method of protecting a lug from unauthorized removal by means of a lug locking device and also protecting the lug locking device from deleterious elements of an external environment by means of a removable case for covering such lug locking device.

With the above and other objects in view, my invention resides in the novel features of form, construction, arrangement and combination of parts presently described and pointed out in the claims.

GENERAL DESCRIPTION

The present invention relates to a removable plastic case for covering substantially all of the exposed surface of a lug locking device in order to protect such device from external adverse conditions such as rain, mud and other deleterious conditions. The body of the lug locking device includes a central body portion having a continuous side wall and a top wall extending across the side wall. In addition, the lug locking device is provided with a removable bottom wall in the form of a bottom plate sized to extend across the opposite margin of the continuous side wall. The bottom wall is provided with an enlarged boss having an aperture sized to receive the lug on the wheel of the vehicle. The aperture is defined by an extended rim which projects toward a recess in the structural member which holds a bolt for removably accommodating the lug. On the top wall thereof, a key-operated lock access slot is provided for actuating the locking mechanism in the lug locking device.

In accordance with the present invention, the plastic case includes a side wall essentially conforming to the shape and size of the side wall of the lug locking device. Furthermore, a connecting wall extends across the side wall of the case and conforms to an additional surface area of the lug locking device. Moreover, an enlarged pocket is formed on the case which is sized and located to accommodate an enlarged boss on the top wall of the locking device.

The protective case of the present invention can be described in further detail in that the case is a one-piece integral plastic case in one embodiment of the present invention. In another embodiment of the present invention, the cover comprises a container which includes a side wall and a connecting wall extending across a portion of the bottom wall of the locking device. This bottom wall is actually located in juxtaposition to the structure which holds the lug. Moreover, a removable cover member is disposed over the side wall in order to provide a two-piece case device.

The present invention can also be defined in further detail in that the plastic case is formed of a somewhat flexible, but non-stretchable, material. In addition, the lug locking device comprises a base wall which is disposed in juxtaposition to the member holding the lug as aforesaid. The lug locking device also includes the outwardly extending boss which in turn includes a central chamber to receive the lug. Moreover, the case includes such connecting wall which extends from the last-named end of the case which holds the lug to the outwardly extending boss.

The present invention also relates to a method of protecting a lug from unauthorized removal by a lug locking device and which, in turn, includes protection of the lug locking device from deleterious elements of an external environment. This method comprises the disposing of a lug locking device over the lug such that an aperture formed in the body of this lug locking device receives the lug and contains the same in a cavity formed in the body of the device. The method also includes the locking of the lug by means of a locking mechanism also included within the lug locking device. The locking mechanism is operated by a key which extends into the mechanism through a key receiving slot in the lug locking device. Finally, this method includes the disposing of a water-proof case over the body of the lug locking device to completely cover the key-receiving slot and thereby effectively protect the device which receives the lug.

BRIEF DESCRIPTION OF THE DRAWINGS

Figure 1:
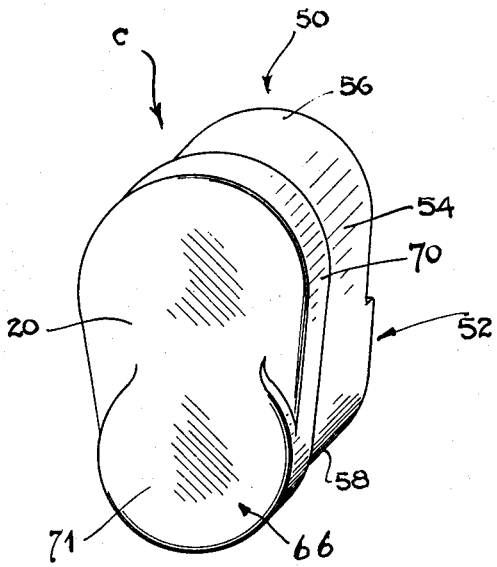
Figure 2:
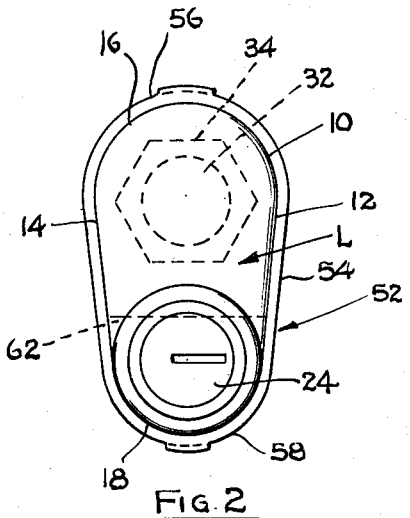
Figure 3:
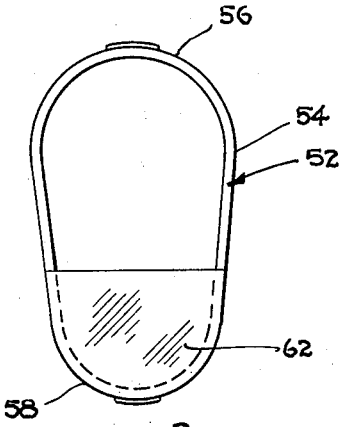
Figure 4:
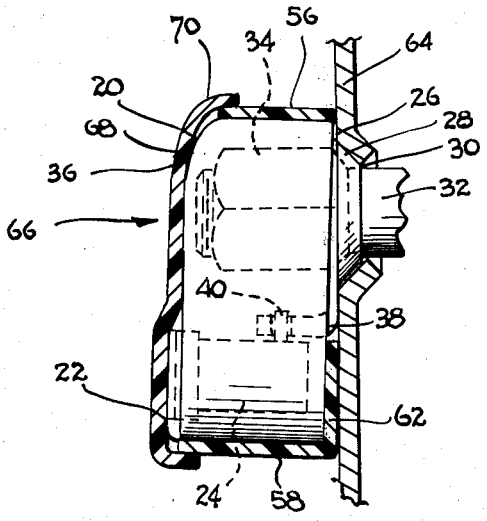
Figure 5:
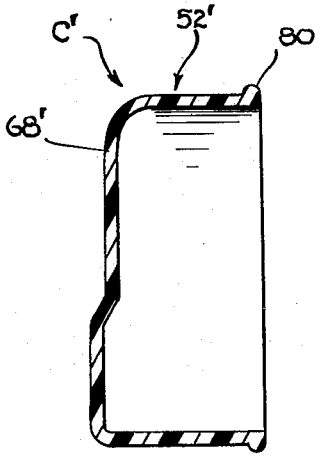
Figure 6:
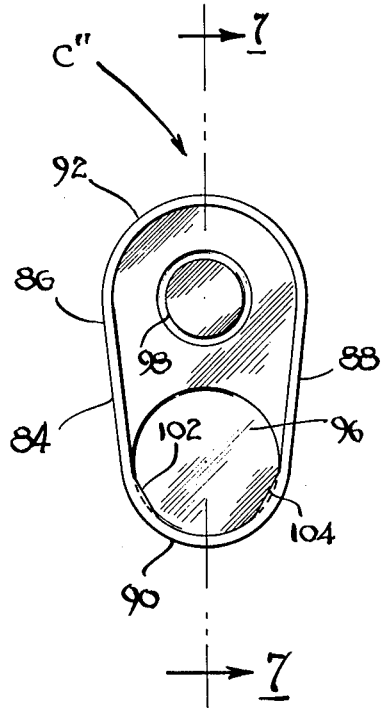
Figure 7:
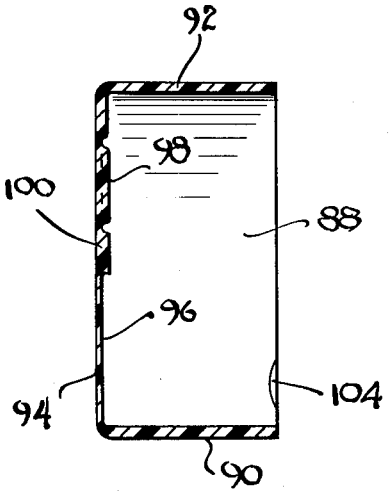

Having thus described the invention in general terms, reference will now be made to the accompanying drawings in which:

FIG. 1 is a perspective view of a case for use with a lug locking device and which case is constructed in accordance with and employing the present invention;

FIG. 2 is a front elevational view of the case with the lid removed, partially in phantom lines, and showing the interior of the case in cooperative engagement with the lug locking device;

FIG. 3 is a rear elevational view of the assembly of the case and lug locking device of FIGS. 1 and 2;

FIG. 4 is a vertical sectional view, partially broken away and in section, and showing a cooperative relation between the lug locking device and the case member of the present invention;

FIG. 5 is a vertical sectional view of modified form of case which may be used in accordance with the present invention;

FIG. 6 is a rear-elevational view of a modified form of case for a lug-locking device which is constructed in accordance with and embodies the present invention; and FIG. 7 is a vertical sectional view, taken along line 7—7 of FIG. 6.

DETAILED DESCRIPTION

Referring now in more detail, and by reference characters to the drawings, C designates a case for use with a lug locking device L, which is designed to secure a lug on an automotive vehicle or similar member to prevent unauthorized removal. Inasmuch as the present invention also relates to the combination of such case C and lug locking device L, and in order to more fully understand the cooperative relationship between the case C and the lug locking device L, the details of construction of both items will be discussed in general terms.

The lug locking device L generally comprises a continuous side wall 10 formed by a pair of relatively flat opposed converging walls 12 and 14 connected by arcuately shaped end walls 16 and 18, in the manner as illustrated in FIG. 2 of the drawings. The housing of the lug locking device also includes a top wall 20, more fully illustrated in FIG. 4, which extends over and connects the upper margin of the side wall 10. By further reference to FIG. 4, it can be observed that the top wall 20 also includes an enlarged, somewhat cylindrically shaped boss 22 which is sized to receive the upper end of a locking mechanism, including a locking cylinder 24. This locking mechanism is also disposed within the body 10 of the locking device L in the manner as illustrated in FIG. 4 of the drawings. The cylinder 24 will include the necessary tumblers and is designed to receive a key (not shown) through a key receiving slot (also not shown) in the top wall 20 of the locking device. In addition, the lug locking device L also includes a bottom wall 26 or so-called "base wall" in the manner as illustrated in FIG. 4 of the drawings.

The bottom wall 26 of the lug locking device L includes an outwardly projecting tapered boss 28 which forms an enlarged aperture 30 to receive the stud 32 projecting from an automotive vehicle or similar member. The aperture 30 is designed to receive the projecting stud 32 which normally accommodates a lug 34. In the conventional mechanism of securing a wheel to a supporting structure, the supporting structure will normally hold the stud 32 which projects outwardly therefrom. In this case, the lug 34 is secured to a threaded section of this stud 32.

In the case of the present invention, the lug locking device L includes a central cavity 36 which is designed to receive the extended end of the stud 32 and the lug 34. Moreover, the lug locking mechanism L includes a keeper 38 which projects inwardly into the lug locking device from the interiorly presented surface of the base 26. The keeper is operable with a tang 40 which is operated by the lock cylinder 24. In this way, when a key is inserted into the lock cylinder 24, various tumblers will cooperate in order to move the tang 40 in order to engage the keeper 38, and thereby retentively hold the locking device L over the lug 34.

The case C of the present invention is more fully illustrated in FIGS. 1–4 of the drawings, and comprises a container 50 comprised of a container shell 52 including a somewhat cylindrical side wall 54 sized and shaped to snugly engage the cylindrical side wall 12 of the lug locking device L. In this respect, it can be observed that the container shell 52 includes arcuately shaped ends 56 and 58 which are designed to snugly engage the arcuate ends 16 and 18 respectively of the lug locking device L.

The case C also integrally includes an inwardly extending base wall 62 which engages a portion of the base wall 26 of the locking mechanism L until such base wall 26 merges into the flange 28. In this respect, it should be observed that one portion of the base wall 26 engages a structural member 64 which retains the stud 32 and the portion of the locking device L which accommodates the bottom wall 62 is spaced from the same surface of this structural member 64. This area of the bottom wall 26 which is spaced from the structural member 64 accommodates the inwardly extending bottom wall of the case C in the manner as illustrated in FIG. 4 of the drawings.

The upper margins of the side wall 54 of the container shell 52 are designed to receive a removable cover or cap 66 which includes a top wall 68 having an integrally formed annular projected flange 70 which engages the upper margins of the side walls 12 and 14 and the arcuately shaped end walls 16 and 18, in the manner as illustrated in FIGS. 2 and 4 of the drawings. In addition, the top wall 68 is integrally provided with an outwardly extending cylindrically shaped section 71 to accommodate the boss 22 on the locking mechanism L.

In accordance with this embodiment of the present invention, it can be observed that the case C snugly engages the exposed exterior surface of the locking mechanism L. In this case, the side wall 54 snugly engages the side walls 12 and 14 of the locking mechanism L and the arcuately shaped walls 16 and 18, respectively, of the locking mechanism L. In like manner, when the cap 66 is disposed on the container 50, the annular flange 70 will snugly engage and fit over the upper margin of the continuous side wall 52. Moreover, the extended section flange 71 will accommodate the boss 22 on the locking mechanism L. In addition, the bottom wall 62 of the case C will fit between the outwardly presented surface of the structure 64 and the bottom wall 26 of the locking mechanism L, in the manner as illustrated in FIG. 4 of the drawings.

In order to assemble the device in the manner as shown, the base plate 26 of the locking mechanism L is removed and the stud 32 inserted within the aperture 30. Thereafter, the lug 34 is threadably secured to the extended end of the stud 32. The body 10 is then disposed over this assembly so that the lug 34 fits within the aperture 30 formed within the bottom wall of the lug locking device L. Thereafter, the shell 52 is disposed about the continuous side wall 10 of the device L. Finally, the cover member or cap 66 is retentively fitted on the outer margins of the continuous shell 52 of the container 50 in order to protectively cover the lug locking device L.

In this way, it can be observed that the case C completely envelopes the lug locking device L and protects all exposed portions thereof from deleterious effects of the external environment. Thus, since the case C protects the lock 24, no water vapor or other forms of deleterious elements can enter into this locking mechanism. In like manner, the lower margins of the continuous side wall 52 engage the surface of the structural member 64, and all other remaining components of the locking device L are protected.

FIG. 5 discloses another form of cover C′ for protecting a locking device L in accordance with the present invention. The cover C′ is similar to the cover C except that the cover C′ includes a top wall 68′ which is integral with a continuous side wall 52′ and, in this case, the continuous side wall 52′ and the top wall 68′ are designed to snugly engage the top wall 20 and the continuous wall 10 of the locking device L. Moreover, the case C′ is provided with an annular outwardly flaring flange 80 along the portion thereof which engages the structural member 64.

In this latter embodiment of the present invention, the case C′ is merely designed to snugly fit over all exposed surfaces of the locking device L and thereby retentively and protectively cover the locking device L. In all other respects, the case C′ is similar to the case C except that the top wall 68′ is integral with continuous side wall 52′.

FIGS. 6 and 7 illustrate another modified form of case C″ which is comprised of a container shell 84 having tapered side walls 86 and 88 connected at their ends through opposed arcuately shaped end walls 90 and 92. A front wall 94 covers, and is integrally formed with, one end margin of the side walls 86 and 88 and the end walls 90 and 92. The front wall 94 is provided with a circularly shaped recess 96 which is sized and shaped to accommodate the cylindrically shaped boss 22. Moreover, the front wall 94 is provided on its interior face with a circularly shaped annular groove 98 which forms a so-called "punch out" to accommodate the outer end of the stud 32. In many cases, the length of the stud 32 may vary and consequently the punch-out is provided so that extra long studs 32 may project therethrough. It can also be observed that the outwardly presented surface 100 of the front wall 94 is relatively flat in this embodiment of the invention.

Furthermore, it can be observed that the rearwardly presented margins of the side walls 86 and 88 are provided with inwardly struck ears 102 and 104 respectively, which are somewhat stiff, but nevertheless sufficiently resilient, in order to engage the body 10 of the lug-locking device L. In this respect, the only two such ears 102 and 104 have been shown, although it should be understood that in accordance with the present invention any number of ears could be employed in any desired location. Moreover, it should also be observed that these ears 102 and 104 could also be used on either of the previously described cases C or C′.

The case C and the case C′ and the case C″ are preferably formed of a molded plastic material which is somewhat resilient, but fairly non-elastic with respect to stretchability. Thus, in this case, the plastic member is formed of a flexible, but nonstretchable, material. Various forms of molded plastics which meet the above criteria may be used in the formation of the cases of the present invention. Thus, polyethylene of low and high density, polystyrene-polybutadiene copolymers and similar forms of resins may be used in the formation of the cases of the present invention. These cases may be formed by blow molding, thermoforming or similar forms of generating the components of the cover members. In addition, it should also be observed that the cases could be formed of other materials which are designed to fit upon the locking mechanism, such as wood, various metals or the like.

Thus, there has been illustrated and described a unique and novel covering case for a lug locking device and an assembly therefor, and which therefore fulfills all of the objects and advantages sought therefor. It should be understood that various changes, modifications and other uses and applications may be made of the case and lug locking device without departing from the nature and spirit and scope of the invention. Therefore, all such changes, modifications, variations and other uses and applications which do not depart from the nature and spirit and scope of the invention are deemed to be covered by the invention which is limited only by the following claims.

Having thus described my invention what I desire to claim and secure by letters patent is:

1. A removable protective case for use with a lug locking device of the type where a bolt-type lug secures a pair of members in locking relationship, and which case is sized and shaped to protect said locking device from adverse external conditions, and wherein said locking device includes a central body portion with a body continuous side wall and a body top wall extending across said body continuous side wall to receive a bolt-type lug and an enlarged boss having a surface for key operated lock access on said locking device; said case comprising a plastic member having a case side wall essentially conforming to the shape of and enclosing said central body portion and a case top wall extending across a portion of said case side wall and being in enclosing relationship therewith and conforming to an additional surface area of said bolt-type lug locking device, and an enlarged pocket on the case top wall of said case sized and located to accommodate said enlarged boss having said surface for key operated lock access.

2. The removable protective case of claim 1 further characterized in that said plastic case is a one-piece integral plastic case.

3. The removable protective case of claim 1 further characterized in that said case comprises a container having said case side wall and said case top wall and a connecting bottom wall extending across a portion of said side wall located in juxtaposition to a structure holding said lug, and said case top wall is a cover member removably disposed over the other end of said side wall with respect to said bottom connecting wall.

4. The removable protective case of claim 1 further characterized in that said plastic member is formed of a somewhat flexible but non-stretchable material.

5. The removable protective case of claim 1 further characterized in that said lug locking device comprises a base wall which is disposed in juxtaposition to a member holding a lug, and said locking device comprises an outwardly extending boss on said base wall and having a central aperture to receive said lug, and the portion of the base wall from said outwardly extending boss to one end of said central body portion being spaced from the member holding the lug, and said case includes a bottom connecting wall which extends from said last named end of said case to said outwardly extending boss.

6. A combination of a lug locking device for locking a lug against inadvertent or theft removal, and a case for said lug locking device; said lug locking device comprising a continuous lug locking side wall with a lug locking top wall extending across a portion of said lug locking device and a lug locking bottom wall extending thereacross and which bottom wall extends thereacross to form an interior chamber, and which lug locking bottom wall is located in juxtaposition to a member holding said lug, said lug locking bottom wall having an aperture to receive said lug which is capable of being disposed in said interior chamber, said case comprising a case side wall which encircles the lug locking side wall of said locking device, and a case top wall of said case which is disposed over and completely covers the lug locking top wall of said locking device.

7. The combination of claim 6 further characterized in that the case top wall of said case snugly engages the lug locking top wall of said locking mechanism, and the case side wall of said case snugly engages the lug locking side wall of said locking device.

8. The combination of claim 7 further characterized in that the case top wall of said case is removable from the side wall of said case.

9. The combination of claim 7 further characterized in that the case top wall of said case is integral with the side wall of said case.

10. The combination of claim 7 further characterized in that said case comprises a case bottom wall which extends over and engages a portion of the lug locking bottom wall of said locking mechanism.

11. A method of protecting a lug from unauthorized removal by a lug locking device and protecting the lug locking device from deleterious elements of an external environment, said method comprising disposing said lug locking device having a device top wall and a continuous side wall forming a body over said lug such that an aperture formed in the body of said device receives said lug and contains same in a cavity formed by the body of said device, locking said body by means of a locking mechanism in said lug locking device with a key which extends into said locking mechanism through a key receiving aperture in the body of said lug locking device, and disposing a waterproof case having a case top wall and case continuous side wall over the body completely over the key receiving aperture to effectively cover the aperture which receives the lug such that the case top wall and case side wall of said case snugly engage the device top wall and side wall of said locking device.

12. The method of claim 11 further characterized in that the case top wall of said case is removable from the case side wall thereof.

13. The method of claim 11 further characterized in that the case top wall of said case is integral with the case side wall thereof.

14. A combination of a lug locking device for protecting a lug from unauthorized removal by said lug locking device and a removable protective case for protecting the lug locking device from deleterious elements of an external environment, said combination comprising a body forming said locking device and which is capable of being disposed over said lug such that means forms an aperture in the body of said device which receives said lug and contains same in a cavity formed by the body of said device, said body forming said lug locking device comprising a top wall and a continuous side wall, a locking mechanism in said lug locking device for locking said body with a key which extends into said locking mechanism through a key receiving aperture in the body of said lug locking device, and a waterproof case disposed over the body and completely over the key receiving aperture to effectively cover the aperture which receives the lug, and said case having a top wall and a continuous side wall such that the top wall and side wall of said case snugly engage the top wall and side wall of said locking device.

15. The combination of claim 14 further characterized in that the top wall of said case is removable from the side wall thereof.

16. The combination of claim 14 further characterized in that the top wall of said case is integral with the side wall thereof.

17. A removable protective case for a lug locking device to protect said locking device from adverse external conditions, and wherein said locking device includes a central body portion to receive a lug and a base wall forming part of said body portion and an enlarged outwardly extending boss on said base wall having a surface for key operated lock access, and which base wall is disposed in juxtaposition to a member holding said lug; said case comprising a plastic member having a case side wall essentially conforming to the shape of said central body portion and a case bottom wall extending across said case side wall and conforming to additional surface area of said lug locking device, an enlarged pocket on said case sized and located to accommodate said boss, the portion of the base wall from said outwardly extending boss to one end of said central body portion being spaced from the member holding the lug, and said case includes a case bottom wall which extends from said last named end of said case to said outwardly extending boss.

18. The removable protective case of claim 17 further characterized in that said plastic case is a one-piece integral plastic case.

19. The removable protective case of claim 17 further characterized in that said case comprises a container having said case side wall and a case top wall extending across a portion of said side wall located in spaced apart relation to a structure holding said lug, and said top wall forms part of a cover member removably disposed over the other end of said side wall.

20. The removable protective case of claim 17 further characterized in that a case top wall on said central body portion of said case snugly engages a lug locking top wall on the central body portion of said locking mechanism, and the case side wall of said case snugly engages the lug locking side wall of said locking device.

21. The removable protective case of claim 20 further characterized in that the case top wall of said case is removable from the side wall of said cover.

22. The combination of claim 20 further characterized in that the case top wall of said case is integral with the side wall of said case.

23. The combination of claim 20 further characterized in that said case bottom wall extends over and engages a portion of the base wall of said locking mechanism.

* * * * *